United States Patent [19]

Harding

[11] 4,291,515

[45] Sep. 29, 1981

[54] STRUCTURAL ELEMENTS

[75] Inventor: Claude G. Harding, Newcastle, Australia

[73] Assignee: John Lysaght International Holdings S.A., Panama

[21] Appl. No.: 87,898

[22] Filed: Oct. 24, 1979

[30] Foreign Application Priority Data

Nov. 7, 1978 [AU] Australia ..... PD6674

[51] Int. Cl.[3] ..... E04C 2/42

[52] U.S. Cl. ..... 52/694; 52/653; 52/731

[58] Field of Search ..... 52/693, 694, 730, 731, 52/655; 654, 653, 650

[56] References Cited

U.S. PATENT DOCUMENTS

| | | | |
|---|---|---|---|
| 1,465,307 | 8/1923 | Keogan | 52/653 |
| 2,075,772 | 3/1937 | Vass | 52/694 |
| 2,136,071 | 11/1938 | Braden | 52/694 |

FOREIGN PATENT DOCUMENTS

| | | | |
|---|---|---|---|
| 137162 | 11/1933 | Austria | 52/693 |
| 555849 | 4/1957 | Belgium | 52/648 |
| 835647 | 2/1952 | Fed. Rep. of Germany | 52/694 |
| 520413 | 6/1921 | France | 52/650 |
| 125748 | of 1919 | United Kingdom | 52/730 |
| 234878 | 5/1925 | United Kingdom | 52/694 |

*Primary Examiner*—James A. Leppink
*Assistant Examiner*—Henry E. Raduazo
*Attorney, Agent, or Firm*—Beveridge, DeGrandi, Kline & Lunsford

[57] ABSTRACT

A girder or like structural element of the kind consisting of a pair of chords, which are usually parallel, and a web in the form of a zigzag strip consisting of oblique straights alternating with crests by which the web is joined to and between the chords by welding or otherwise, is characterized in that each of the crests is a flat of parallelogrammatic form and has the larger of the supplementary angles of the parallelogram at between 120° and 150°; and, each of the straights has its major cross-sectional dimension extending in a plane parallel to that of the chords or at least having a component parallel to the plane of the chords.

18 Claims, 16 Drawing Figures

STRUCTURAL ELEMENTS

This invention relates to structural elements such as girders, trusses, rafters and others in the form of a top chord, a co-planar bottom chord and a web being a zigzag strip composed of inclined straights alternating with crests through which the web is secured to and between the two chords.

It is already known to make structural elements of the kind indicated above. An example is shown in FIGS. 1 and 13 of the drawings herewith.

FIG. 1 is a partly sectioned side elevation of part of a girder, and FIG. 13 is a plan of part of the web of the same girder (on an enlarged scale).

The girder of FIGS. 1 and 13 is composed of two co-planar chords 17 (which in this instance are parallel) both of channel section and each having its flanges directed towards those of the other, and a web in the form of a zigzag strip consisting of inclined straights 18 alternating with crests in the form of rectangular flats 19. The straights may be formed with stiffening ribs 20 and the web is secured to the chords by welding, bolting or riveting the crests 19 to the webs of the chords.

The chords need not be channels with their flanges directed towards each other, they could (for example) be in the form of strip material, or they may be channels with their flanges directed away from each other.

A difficulty with the prior girders is that the longitudinal axes (21) of neighbouring straights intersect well beyond the longitudinal axis (22) of the related chord as indicated at 23, whereas the ideal situation would be for the axes of the straights to intersect in the longitudinal axis of the chord, otherwise the chord is under eccentric loadings and this gives rise to additional bending stresses in the chord and the consequent need to make the chords heavier than otherwise would be necessary in order to accommodate the additional stresses. Because of this difficulty it has been proposed to make the flats 19 relatively short, but there is a restriction on this because of the practical necessity to provide sufficient space for making a satisfactory and easily made joint between chords and crests.

In referring to the "longitudinal axis" of a member forming part of a girder, it is intended to refer to that axis or centre-line of the member which corresponds with the line which, in a conventional force diagram of the structural element, represents the force imposed on the particular member when the element is under load. Where the member is of uniform cross-sectional shape and the member end connections are on the same axis, the member axis and the force line are coincident. Where this is not so the two lines are very nearly coincident, otherwise, the design, as a structural element, is inept, particularly so far as compression members in the element are concerned.

The object of the present invention is to provide a structural element of the kind indicated, in which the web flats may be made ample in area while bringing the longitudinal axes of the web straights more nearly into the ideal intersecting relationship with the longitudinal axes of the chords.

The invention provides a structural element consisting of two co-planar chords and a web in the form of a zigzag strip composed of inclined straights alternating with crests by which the web is secured to and between both of the chords, characterised in that:

(a) each of said crests is parallelogrammatic and the larger angle of the two supplementary angles at the respective ends of any one side of the crest is between 120° and 150°; and, (b) the major cross-sectional dimension of each of said straights extends in a plane having at least a component parallel to the plane of said chords.

Examples of the invention are illustrated in FIGS. 2 to 12 and FIGS. 14 to 16 of the drawings herewith.

Figure 1:
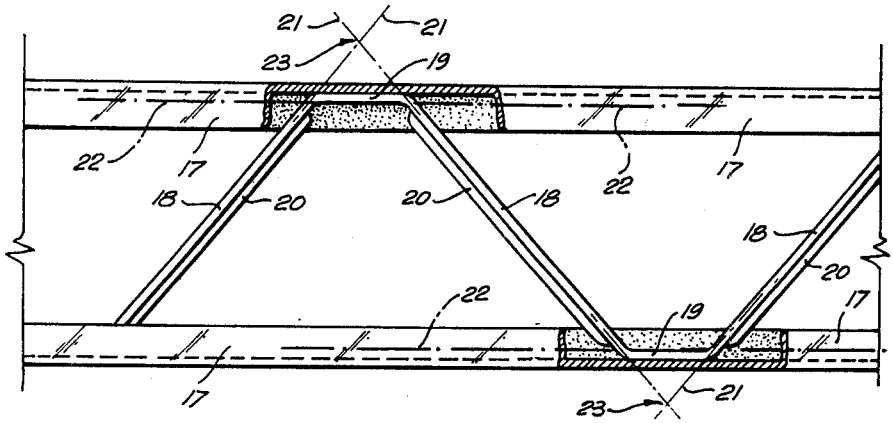
Figure 2:
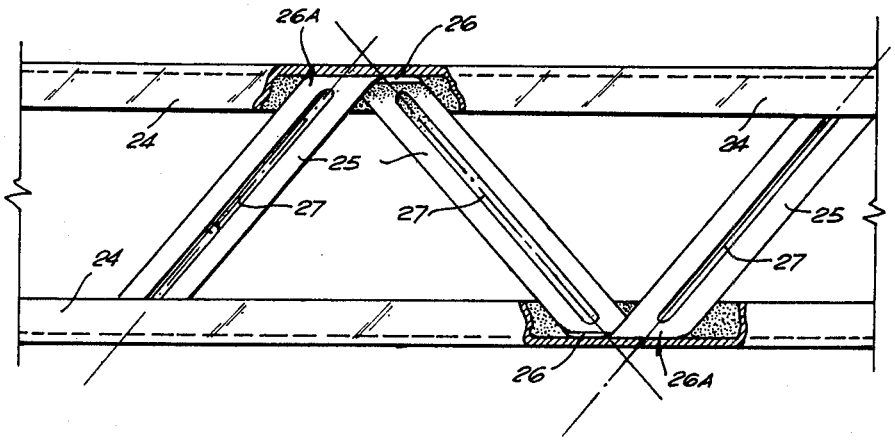
FIG. 2 is a partly-sectioned side elevation of a structural member having chords which are parallel as well as co-planar.
Figure 4:
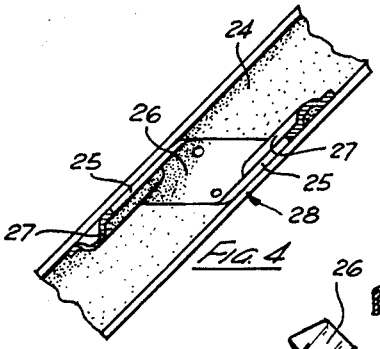
FIG. 4 is a fragmentary plan taken on line 4—4 in FIG. 3.

Referring to FIGS. 2 to 4 and 14, the girder consists of two co-planar and parallel chords 24 and a web composed of straights 25 and crests 26. The chords 24 are of channel cross-sectional shape with the flanges of each directed towards those of the other. The crests 26 are constituted by parallelogrammic flats (26) and the web is secured to the chords by joining the flats to the webs of the chords by welding, bolting, riveting or otherwise. The straights 25 are preferably each provided with a stiffening rib 27.

Each of the flats 26 is defined at its ends by bends or folds in the strip out of which the web is made. These bends (26A) are spaced apart, parallel to each other and to the chords; that is, relative to the length of the strip, but oblique relative to that strip itself. Thus, the flats are parallelogrammic in such manner that the larger angle (indicated at "a" in FIG. 14) of the two supplementary angles ("a" and "b") at the respective ends of any one side of the flat or crest, is between 120° and 150°.

Figure 13:
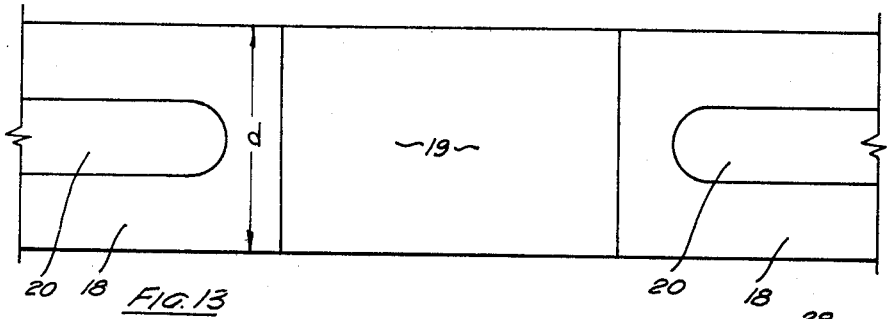
Figure 14:
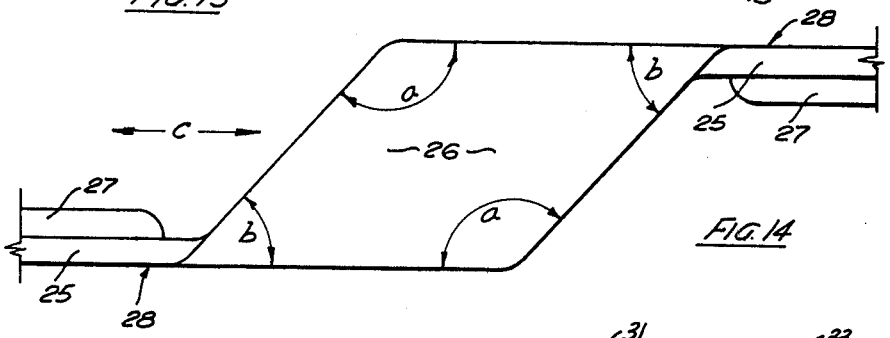
FIGS. 14 to 16 are each views similar to FIG. 13 but respectively related to FIGS. 2 to 4, FIGS. 5 to 9 and FIGS. 10 to 12.

The major surfaces 28 of each straight extend longitudinally of the finished girder as indicated by span "c" in FIG. 14, as distinct from being perpendicular to the girder as indicated by span "d" in FIG. 13.

Figure 6:
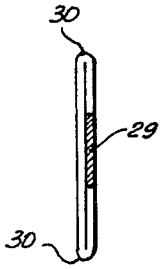
FIG. 6 is a sectional end elevation taken on line 6—6 in FIG. 5.
Figure 7:
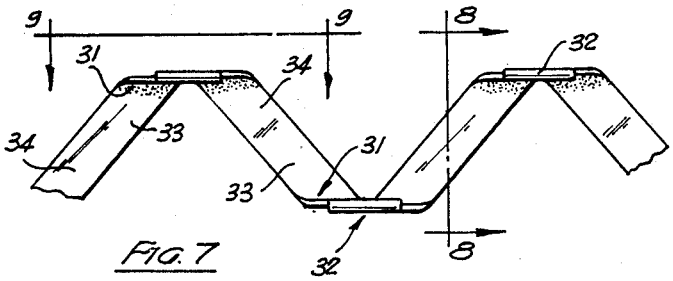
FIG. 7 shows the intermediate stage of FIG. 5 brought to completion.

Referring to FIGS. 5 to 8 and 15, a girder web is formed from a strip by making a first zigzag consisting of preliminary straights 29 alternating with first bends or folds 30 to give an end view such as that of FIG. 6.

Figure 8:
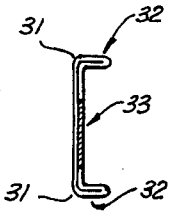
FIG. 8 is a sectional end elevation taken on line 8—8 in FIG. 7.
Figure 9:
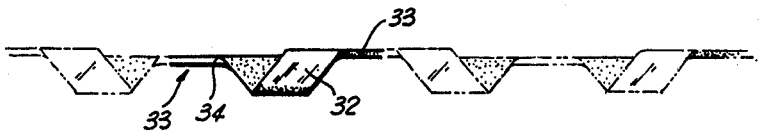
FIG. 9 is a fragmentary plan taken in the direction indicated by line 9—9 in FIG. 7.
Figure 10:
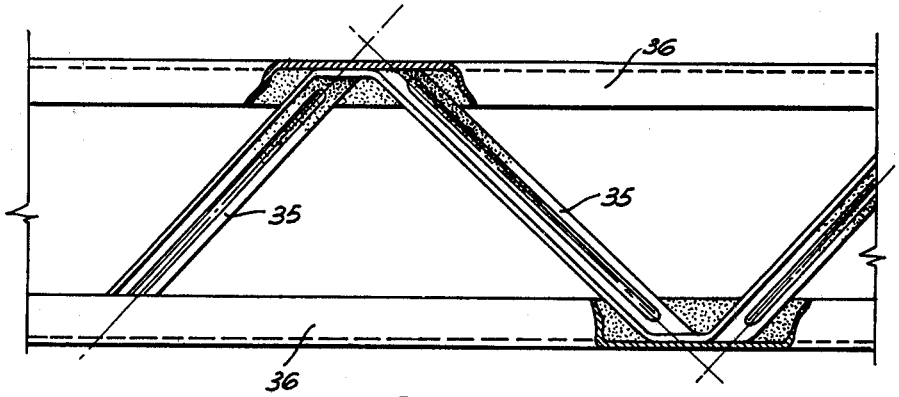
FIG. 10 is a view similar to FIG. 2 showing a modified form of a structural member.
Figures 11, 12:
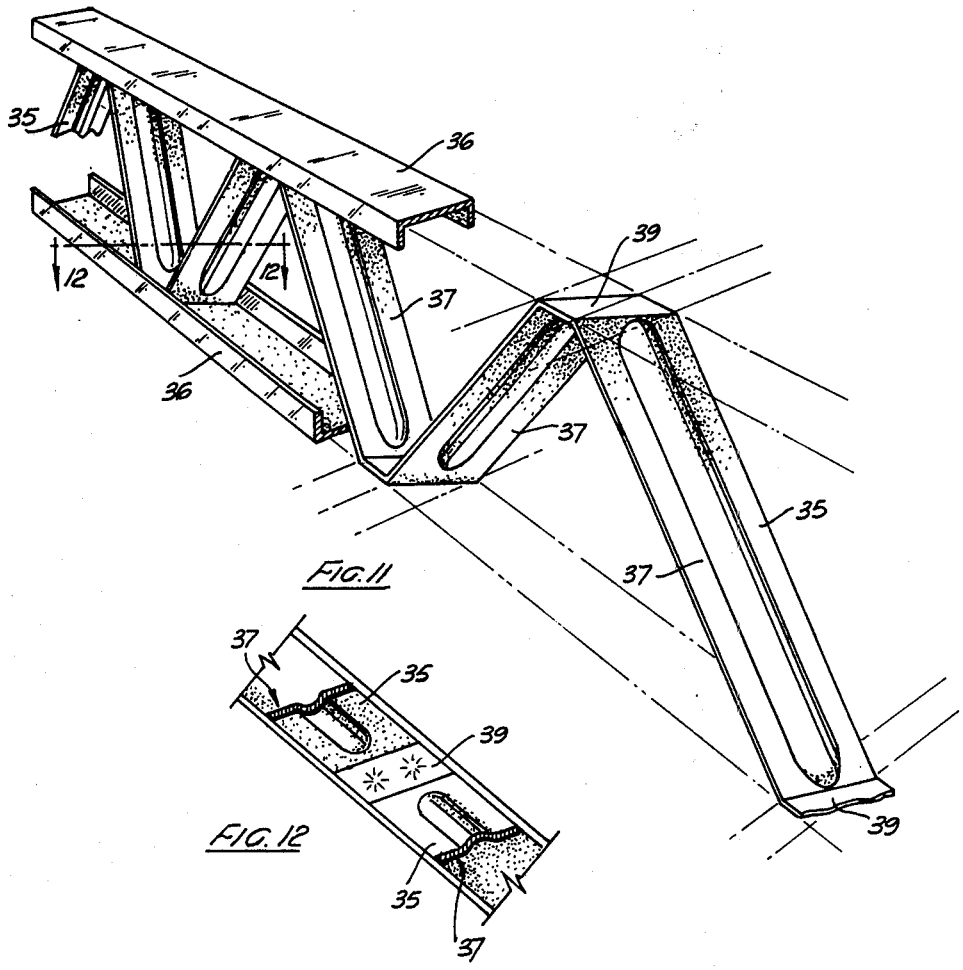
FIG. 11 is a view similar to FIG. 3 of the member shown in FIG. 10.
FIG. 12 is a fragmentary sectional plane taken on line 12—12 in FIG. 11.

Each of the preliminary crests thus constituted by folds 30 is bent over by second (compound) folds 31 spaced from and parallel to the related first fold 30 so to form the required parallelogrammic crests or flats 32. These flats may be co-directed as shown in FIG. 8 and in that case they may be broad enough to extend across the full width of the chord webs to which they are to be attached. Alternatively, flats of the full width indicated could be bent in opposite directions and the straights inclined slightly relative to the plane in which the two chords are co-planar. In another alternative the two flats could be bent in opposite directions (or in the same direction for that matter) but as of a flat width only half the width of the chord web so to permit the web as a whole to be virtually centralised relative to the width of the girder.

Figure 15:
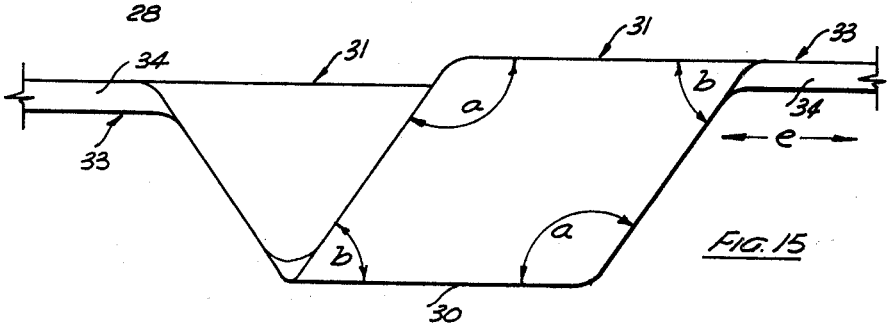

Reverting mainly to FIG. 15 it will be seen that the major surfaces 33 of the straights 34 extend longitudinally of the girder; that is, in the direction indicated by span "e" in FIG. 15. In this embodiment the supplementary angles "a" and "b" are the same as described above in relation to FIG. 14.

Figure 16:
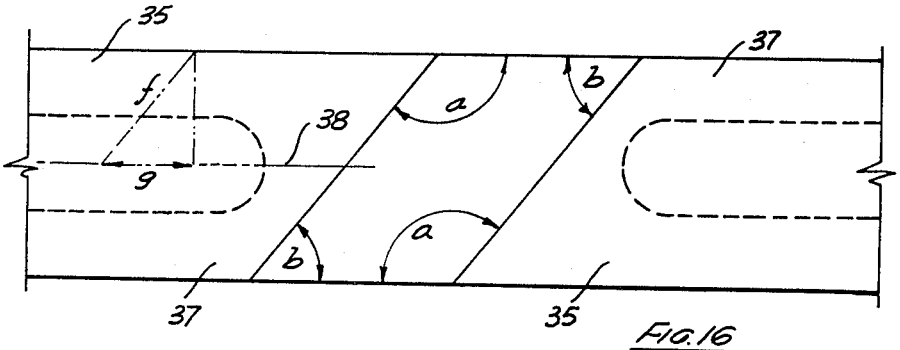

Referring to FIGS. 10 to 12 and 16, the girder there shown is virtually the same as that shown by FIGS. 2 to 4 and 14, except for its straights 35 being disposed obliquely relatively to both the length and the width of the chords 36 so that the major surfaces 37 of the straights 35, instead of extending wholly in the longitudinal direction of the girder (as shown in FIG. 14 or FIG. 15) have only a component of extension in that direction. This is best shown in FIG. 16 where the line "f" indicates the direction of the major surfaces 37, these surfaces thus having a component of extension in the longitudinal direction of the girder (indicated at 38) as represented by span "g". In this embodiment the flats 39 are parallelogrammatic as previously explained, having corner angles "a" and "b" also as explained above.

Figure 3:
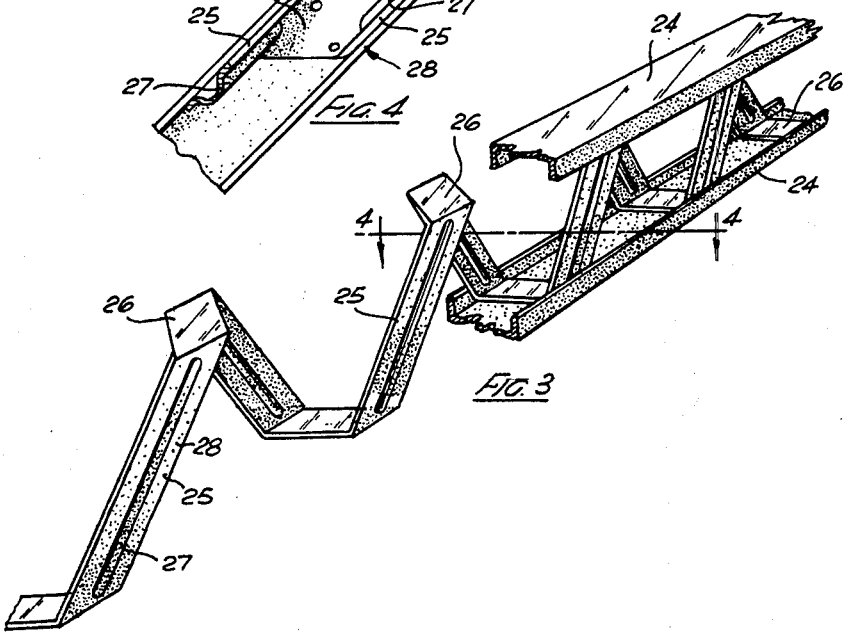
FIG. 3 is a perspective view of a part of the web shown in FIG. 2.
Figure 5:
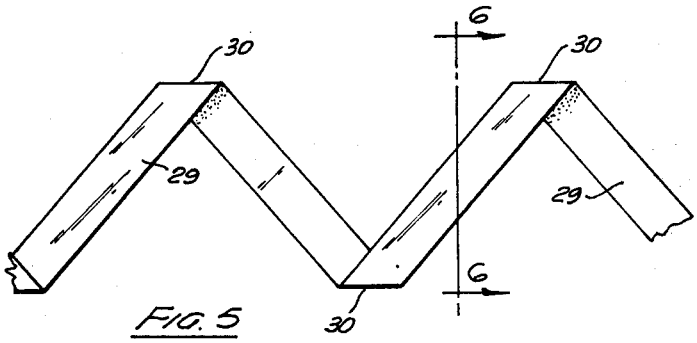
FIG. 5 is a side elevation showing an intermediate stage in the construction of a girder web of modified design.

An important advantage attributable to the present invention is that a plurality of webs may be secured to and between a single pair of co-planar chords. For example, if the web shown in FIG. 3 is regarded as a first "helix" then another similar "helix" could be used with the first, provided the flats of the two helices are sufficiently spaced apart along the chords to permit attachment thereof to the chords. Such spacing of the flats could be omitted if the flats are "half-width" flats as discussed above.

The claims defining the invention are as follows:

1. A structural element comprising two coplanar chords having mutually facing flat surfaces and a web in the form of a zigzag strip having inclined straights alternating with flat crests by which the web is secured to said flat surfaces and between both of the chords, characterised in that:

(a) each of said crests is parallelogrammatic and the larger angle of the two supplementary angles at the respective ends of any one side of the crest is between 120° and 150°; and, (b) the major cross-sectional dimension of each of said straights extends in a plane having at least a component parallel to the plane of said chords.

2. A structural element according to claim 1 wherein said coplanar chords are parallel.

3. A structural element according to claim 1 wherein said chords are channels having the flanges of each directed towards those of the other, and having the said crests disposed between said flanges.

4. A structural element comprising two coplanar chords having mutually facing flat surfaces in the form of a zigzag strip having inclined straights alternating with flat crests by which the web is secured to said flat surfaces and between both of the chords, characterised in that:

(a) each of said crests is parallelogrammatic and the larger angle of the two supplementary angles at the respective ends of any one side of the crest is between 120° and 150°;

(b) the major cross-sectional dimension of each of said straights extends in a plane having at least a component parallel to the plane of said chords; and (c) each of said crests joins its adjacent straights by a pair of folds which are parallel to said chords.

5. A structural elements according to claim 4 wherein said coplanar chords are parallel.

6. A structural elements according to claim 4 wherein said chords are channels having the flanges of each directed to those of the other, and having the said crests disposed between said flanges.

7. A structural element comprising two coplanar chords and a web in the form of a zigzag strip composed of inclined straights alternating with flat crests by which the web is secured to and between both of the chords, characterised in that:

(a) each of said crests is parallelogrammatic and the larger angle of the two supplementary angles at the respective ends of any one side of the crest is between 120° and 150°;

(b) the major cross-sectional dimension of each of said straights extends in a plane having at least a component parallel to the plane of said chords; and (c) each of said crests joins its adjacent straights by a pair of folds which extend obliquely athwart said chords.

8. A structural elements according to claim 7 wherein said coplanar chords are parallel.

9. A structural element according to claim 7 wherein said chords are channels having the flanges of each directed towards those of the other, and having the said crests disposed between said flanges.

10. A structural element consisting of two coplanar chords and a web in the form of a zigzag strip composed of inclined straights alternating with flat crests by which the web is secured to and between both of the chords, characterised in that:

(a) each of said crests is parallelogrammatic and the larger angle of the two supplementary angles at the respective ends of any one side of the crest is between 120° and 150°;

(b) the major cross-sectional dimension of each of said straights extends in a plane having at least a component parallel to the plane of said chords; and (c) each of said crests is formed by a first fold disposed parallel to said chords, and a compound fold spaced from and parallel to said first fold.

11. A structural element according to claim 10 wherein said coplanar chords are parallel.

12. A structural element according to claim 10 wherein said chords are channels having the flanges of each directed towards those of the other, and having the said crests disposed between said flanges.

13. A structural element comprising two coplanar chords made of flat sheet material and having mutually facing flat surfaces and a web in the form of a zigzag strip of flat sheet material comprising inclined straights alternating with flat crests by which the web is secured to said flat surfaces and between both of the chords, characterised in that:

(a) each of said crests is parallelogrammatic and the larger angle of the two supplementary angles at the respective ends of any one side of the crest is between 120° and 150°; and (b) the major cross-sectional dimension of each of said straights extends in a plane having at least a component parallel to the plane of said chords.

14. A structural element according to claim 13 wherein said coplanar chords are parallel.

15. A structural element according to claim 13 wherein said chords are channels having the flanges of each directed towards those of the other, and having the said crests disposed between said flanges.

16. A structural element according to any one of claims 13 to 15 wherein each of said crests joins its adjacent straights by a pair of folds which are parallel to said chords.

17. A structural element according to any one of claims 13 to 15 wherein each of said crests joins its adjacent straights by a pair of folds which extend obliquely athwart said chords.

18. A structural element according to any one of claims 13 to 15 wherein each of said crests is formed by a first fold disposed parallel to said chords, and a compound fold spaced from and parallel to said first fold.

* * * * *